United States Patent [19]

Jenn

[11] Patent Number: 4,685,260

[45] Date of Patent: Aug. 11, 1987

[54] PRECONSTRUCTED MULTIPLE-UNIT HOUSING

[75] Inventor: Louis J. Jenn, Indianapolis, Ind.

[73] Assignee: Atrium Structures, Inc., Indianapolis, Ind.

[21] Appl. No.: 896,305

[22] Filed: Aug. 12, 1986

Related U.S. Application Data

[63] Continuation of Ser. No. 823,125, Jan. 27, 1986, abandoned, which is a continuation of Ser. No. 513,734, Jul. 14, 1983, abandoned.

[51] Int. Cl.[4] ..... E04H 1/00

[52] U.S. Cl. ..... 52/169.3; 52/79.1; 52/79.3

[58] Field of Search ..... 52/79.1, 79.3, 79.7, 52/79.8, 79.14, 169.3

[56] References Cited

U.S. PATENT DOCUMENTS

| | | | |
|---|---|---|---|
| T964,001 | 11/1977 | Ferwerda | 52/79.1 |
| 1,156,693 | 10/1915 | Koger | 52/79.7 |
| 3,609,929 | 10/1971 | Brown | 52/79.7 |
| 3,629,983 | 12/1971 | Jenn | 52/79.3 |
| 3,640,037 | 2/1972 | Renauld | 52/169.3 |
| 3,678,639 | 7/1972 | Panitz | 52/79.1 |
| 3,874,137 | 4/1975 | Gentry | 52/169.3 |
| 3,996,709 | 12/1976 | Coxe | 52/169.3 |
| 4,258,512 | 3/1981 | Delk | 52/79.7 |

*Primary Examiner*—Henry E. Raduazo

*Attorney, Agent, or Firm*—Woodard, Weikart, Emhardt & Naughton

[57] ABSTRACT

An arrangement of dwelling units for multiple-family housing includes a plurality of elongate units which are arranged relative to one another in a quadrangle configuration such that a major portion of one side of each unit cooperates with the major portion of a side of the other three units to generally enclose an open-air court. Each elongate unit is of a double width comprising an outer single-wide section which is assembled to an inner single-wide section at the building site. This enables each of the single-wide sections to be preconstructed at a plant and then transported over the highway to the actual construction location. Additionally, each of the elongate units is arranged with a living section and adjacent thereto a storage section which may be a garage area. Each of the elongate units has the free end of its living section disposed adjacent a side of a storage section of another elongate unit at a location which is remote from the free end of the storage section and this defines the major portion which in turn results in defining the enclosed open-air court.

6 Claims, 6 Drawing Figures

25

PRECONSTRUCTED MULTIPLE-UNIT HOUSING

This application is a continuation, of application Ser. No. 823,125, filed 1/27/86 and now abandoned which is a continuation of Ser. No. 513,734 filed 7/14/83 and now abandoned.

BACKGROUND OF THE INVENTION

Although multiple-unit housing has long been recognized for its space efficiency and maximum utilization of land, the last 20 years has seen a significant increase in the number of multiple-unit housing starts wherein the building modules are substantially preconstructed in a plant and then transported to a location where they are assembled.

Representative of this type of construction and concept is the housing arrangement disclosed in my prior U.S. Pat. No. 3,629,983. This prior patent discloses a particular arrangement of dwelling units wherein the units are arranged in such a manner as to generally enclose an open-air court. The units have a staggered assembly, corner to corner, in the shape of a square or quadrangle where an end of one unit abuts the side of an adjacent unit, and so forth until the courtyard area is enclosed by a total of four units, as the minimum number in the exemplary embodiment.

The preconstructed, multiple-unit housing disclosed in my prior patent included variations such as adding a second story and creating walkways to and from the open-air court. While still utilizing the basic concepts of an enclosed courtyard, it is envisioned that improvements can be made to the structure in the type of construction and architectural designs which are possible. However, one remaining limitation is the width of the preconstructed unit due to the width of roads and highways over which this unit must travel from the plant to the housing location.

What the present invention provides is a novel approach to enable the square footage of each unit to be increased without increasing the width limitation of the units for transporting across the highways. This improvement is achieved by designing each single-width housing unit with an open wall such that facing open walls of two units can be abutted together and secured in place thereby doubling the square footage of a single-wide unit. Further, the present invention provides, by its structure, a means of incorporating a garage or similar storage area which is attached to the housing quarters thereby enabling the beneficial and novel improvement of an attached garage as part of this multiple-unit housing arrangement. This resulting assembly provides a closer simulation to conventional multiple-unit housing in that there is an increase in square footage of living space which is not limited in width to what can be transported over the highway. The structure of an attached garage is a feature which most multiple-unit housing does not have. Whether this is due to the configuration of such units or the cost, the present invention enables this type of construction and is an improvement over what is currently known to exist.

Although U.S. Pat. No. 3,629,983 is believed to be the closest and most relevant reference to the present invention, the references cited during the prosecution of that patent application may be of some interest with regard to the present invention. However, a review of each of these patents and the publication reveal that the structural concepts of the present invention are novel and unobvious in that they are not found in any of the prior references nor are they taught by any combination of such references.

SUMMARY OF THE INVENTION

An arrangement of dwelling units according to one embodiment of the present invention comprises a plurality of elongate units arranged relative to one another so that a major portion of one side of each unit cooperates to generally enclose an open-air court, each of the elongate units is arranged with a living section and adjacent thereto a storage section, each section has a free end which are at opposite ends of the corresponding elongate unit, each of the elongate units has the free end of its living section disposed adjacent a side of the storage section of another elongate unit at a location remote from the free end of the storage section of the other elongate unit thereby defining the major portion, and each of the elongate units has the free end of its storage section projecting beyond still another elongate unit.

An arrangement of dwelling units according to another embodiment of the present invention comprises a plurality of elongate units arranged relative to one another so that a major portion of one side of each unit cooperates to generally enclose an open-air court, each of the elongate units being arranged as a double-wide unit comprising an outer single-wide section assembled to an inner single-wide section, each of the elongate units having one end disposed adjacent the side of another elongate unit at a location remote from an end of another elongate unit thereby defining the major portion, and each of the elongate units having its opposite end projecting beyond still another elongate unit.

One object of the present invention is to provide an improved arrangement of dwelling units.

Related objects and advantages of the present invention will be apparent from the following description.

DESCRIPTION OF THE PREFERRED EMBODIMENT

Figure 1:
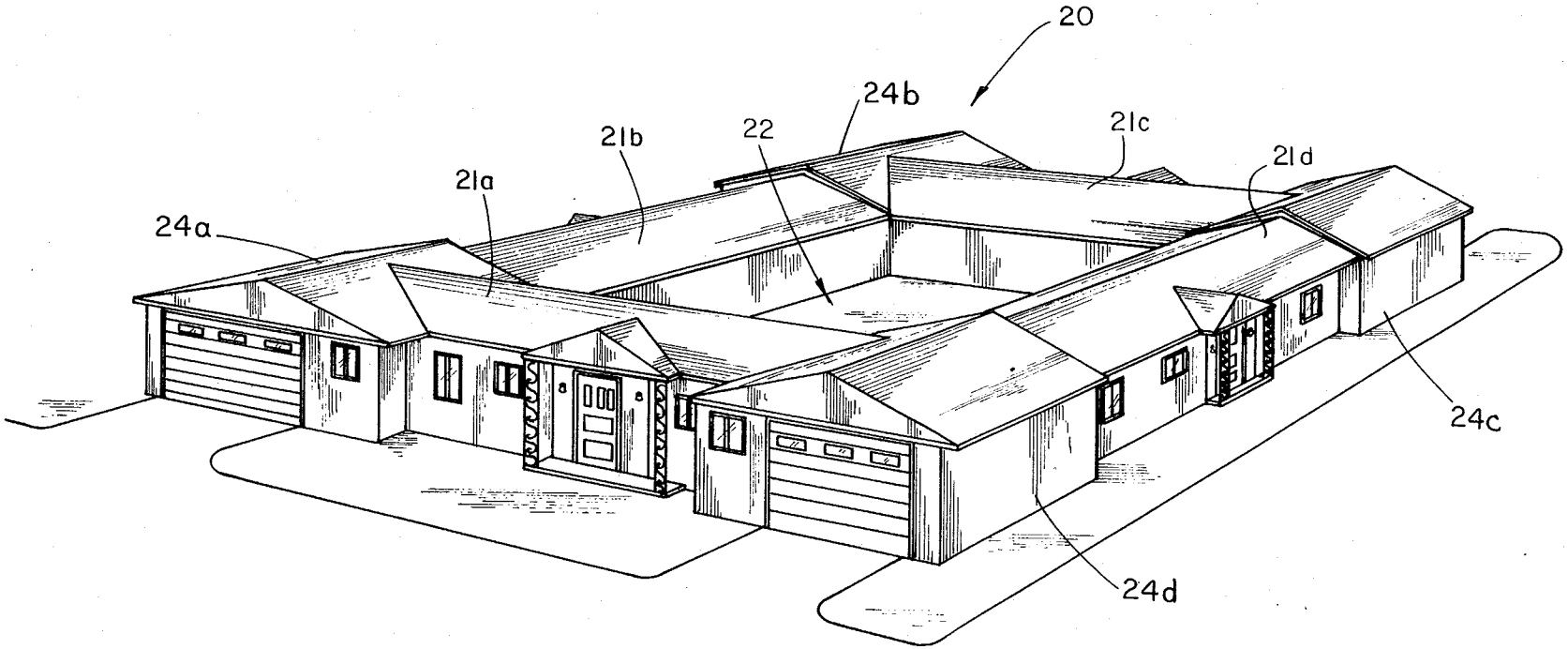
FIG. 1 is a perspective view showing four elongate, single-story dwelling units arranged as a quadrangle according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an arrangement 20 of dwelling units 21*a*–21*d* which are arranged in an end-to-end fashion so as to create a quadrangle shape defining an interior open-air courtyard 22. Each of the units 21*a*–21*d* is configured with a living section 23*a*–23*d*, respectively, and a storage section 24*a*–24*d*, respectively. Each unit may be arranged symmetrically to each other unit and disposed symmetrically in order to create the referenced quadrangle as was the case in my prior U.S. Pat. No. 3,629,983. However, in the exemplary embodiment of FIG. 1, the storage sections 24*a* and 24*d* have been oriented in a similarly-facing direction on each end of living section 23*a*. Similarly, storage sections 24*b* and 24*c* are oriented so as to face in the same direction and are disposed at opposite ends of living section 23*c*. One advantage of the arrangement of the storage sections in the manner described for the exemplary embodiment is that if these storage sections are utilized as garages, which in fact is their configuration in the exemplary embodiment, then access to the garages on one side can be from the same parallel running road while access to the two garages on the opposite side of the quadrangle will be by means of a single also parallel-running road. If in the alternative each garage is oriented with its living section in an identical manner, then four access roads would be required in order to access each of the four garages, and it is conceivable that this number of roads and the traffic pattern created would be awkward and inefficient. The access roads to each pair of garages are noted at 25 and 26 including the short driveway runs connecting these access roads to the various garage entrances.

Figure 3:
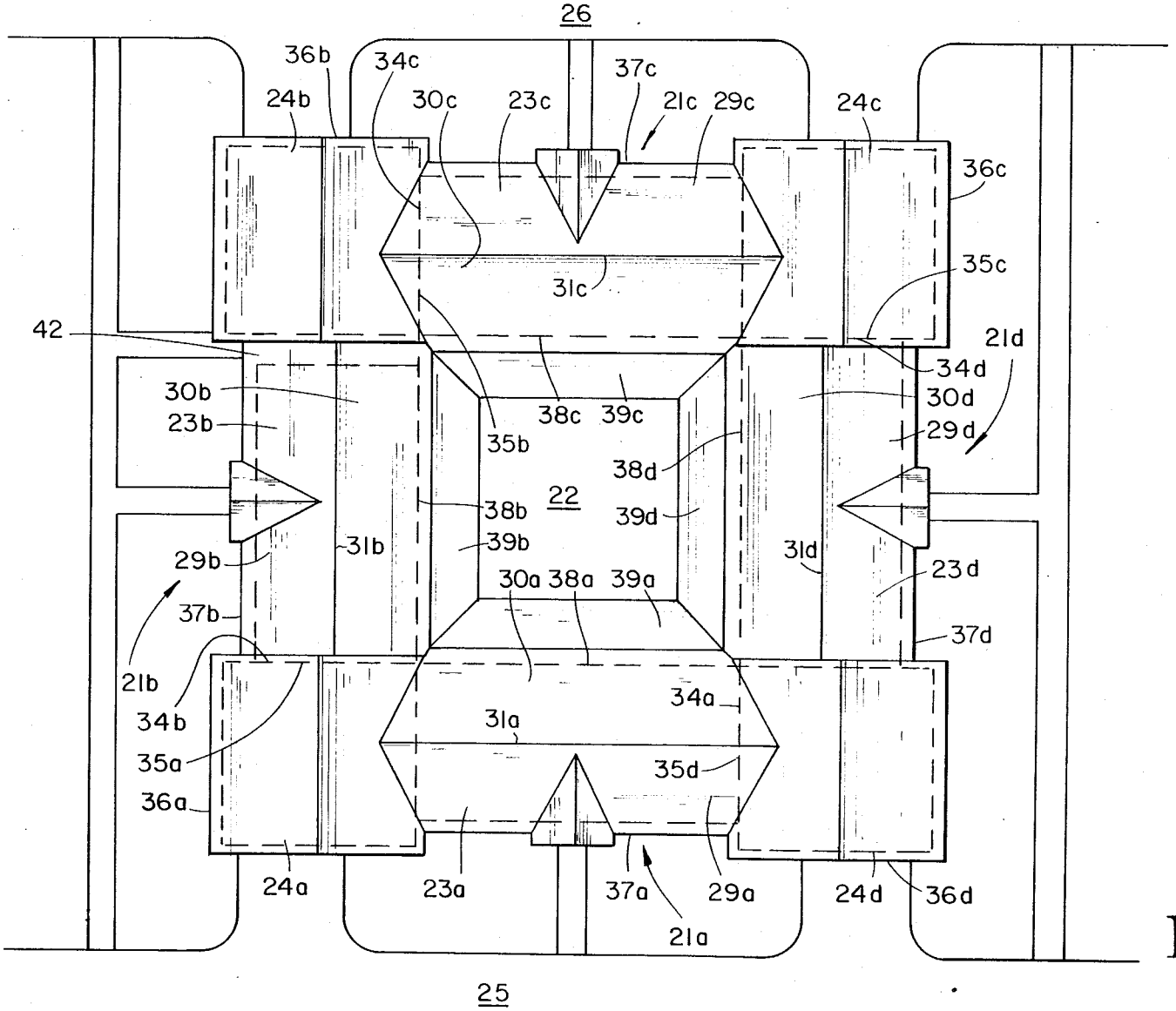
FIG. 3 is a top plan view of the FIG. 1 quadrangle.

As is best illustrated in the FIG. 3 top plan view, each living section is of a double-width construction comprising an outer single-wide section 29*a*–29*d*, respectively, and a single-wide inner section 30*a*–30*d*, respectively. The corresponding single-wide sections are assembled together in order to create the double-wide unit which is illustrated. As should be understood from the present invention and from an understanding of my prior U.S. Pat. No. 3,629,983, which is hereby incorporated by reference, the outer single-wide section is substantially the same width as the inner single-wide section, each of which are substantially the same width as the elongate preconstructed dwelling units of my prior patent. Inasmuchas these dwelling units are prefabricated (preconstructed) at a plant and then transported across roads or highways to the construction location, there is a width limitation due to the width of the roads. Consequently, prior to the present invention, these types of preconstructed dwelling limits were limited in width by the size that could be transported over the highways. By means of the present invention, it is now possible to transport single-width housing units to the construction site and them assemble them together at the location thus doubling the overall square footage while providing twice the unit width. As should be well understood, the comfort of the living quarters and the ability to design those quarters consistent with conventionally constructed apartment houses is greatly enhanced by the ability to provide a preconstructed dwelling unit having a double width. In this regard, each single width unit 29*a*–29*d* and 30*a*–30*d* has an interior face which is covered during transporting and then at the construction site the cover is removed and the open faces are arranged in an abutting orientation to one another and are secured together. Their union results in an abutment line 31*a*–31*d*, respectively, and it is along this abutment line that the two single-wide sections are secured together. Although certain finishing steps are no doubt necessary once the two single-wide sections are joined together, the assembly procedure is relatively simple. Securement may be made by bolts or related fasteners at a plurality of uniformly spaced points around the periphery of the open face. Thereafter, any exterior covering and any roofing is applied over the interface (abutment line) and the units are finished on location. Although the techniques for securing the two single-wide sections together may vary depending upon the architectural style and the preferences of the contractor, what is important to recognize is that the double width resulting unit not only is an improvement to the earlier design because of its ability to double the square footage, but the resultant length versus width dimensions produce a modular unit with a floor plan more consistent with conventional multi-unit dwellings.

As should be appreciated from the FIG. 3 illustration, the storage sections 24*a*–24*d*, which in the exemplary embodiment are garages, are substantially square and their sides are slightly larger than the double width of the individual dwelling units. Consequently, while the ends of each living section abut up against one side of a corresponding storage section, the storage sections actually extend beyond the living sections in a staggered and offset manner consistent with that arrangement of my prior U.S. Pat. No. 3,629,983. The particular arrangement of staggered and offset connections between the individual elongate units is described in the following manner. The free end 34*a* of living section 23*a* is disposed adjacent side 35*d* of storage section 24*d* at a location which is remote from the free end of storage section 24*d*. The concept of being "at a location remote" is provided for by the fact that free end 36*d* of storage section 24*d* extends beyond the outer side surface 37*a* of living section 23*a*. Clearly, the greater the distance between end 36*d* and surface 37*a*, the more remote the location at which free end 34*a* adjoins side 35*d*. In the exemplary embodiment, the storage sections 24*a*–24*d* have been limited to a single unit size and in the case of a garage are simply a single-car garage. In the event the storage sections were designed for something other than a garage or a larger garage such as for two cars, then it should be understood that the degree or the dimension of the mismatch between surface 37*a* and end 36*d* would be more pronounced.

This particular assembly pattern and concept repeats itself with each of the elongate units throughout the quadrangle. In this manner, the free end 34*b* of living section 23*b* is disposed adjacent to side 35*a*, and free end 36*a* extends outwardly beyond outer side surface 37*b*.

While the inside surfaces of the elongate units cover both the inside surface of the living section as well as the inside surface of the storage section, the majority of the inside surface portion of the storage sections are disposed adjacent the ends of the various and cooperating living section. Consequently, what comprises a major portion of one side of each unit is the living section and it is the inside surfaces 38*a*–38*d* which represent a major portion of the side of each elongate unit and it is this portion which cooperates with each of the other portions to generally enclose open-air courtyard 22. Disposed in an inwardly directed manner from the top inside surface edge of each living section is a nine-foot wide canopy which is configured into four sections 39*a*–39*d* each corresponding to the similarly identified living sections 23*a*–23*d*. The various canopy sections are not illustrated in FIG. 1 solely to enable a clearer illustration of the courtyard and the unit-to-unit assembly. The presence of the canopy sections provide a shade area around the periphery of the defined and enclosed open-air courtyard 22 enabling patio furniture and similar items to be placed beneath the canopy so that the open-air environment can be enjoyed without the sun beating down on the occupants of the various dwelling units. However, as should be apparent from FIG. 3, there is still a significant surface area that remains exposed to the sun for those activities where exposure to the sun is desired, such as sunbathing or patio parties.

Figure 2:
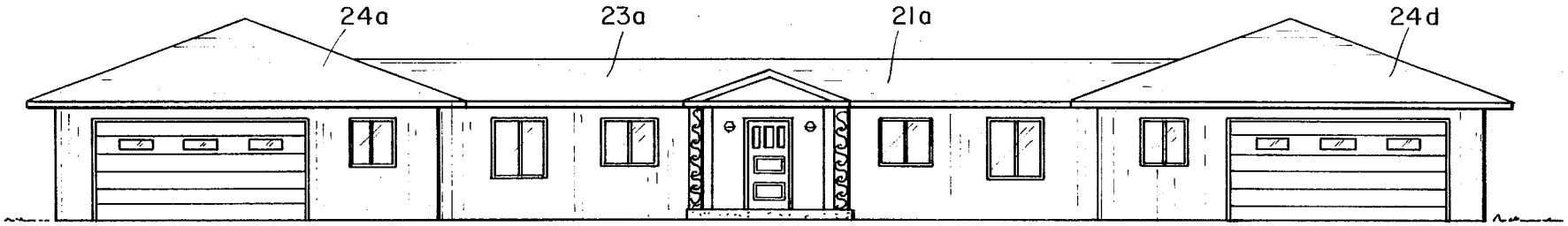
FIG. 2 is a front elevation view of the FIG. 1 quadrangle.
Figure 4:
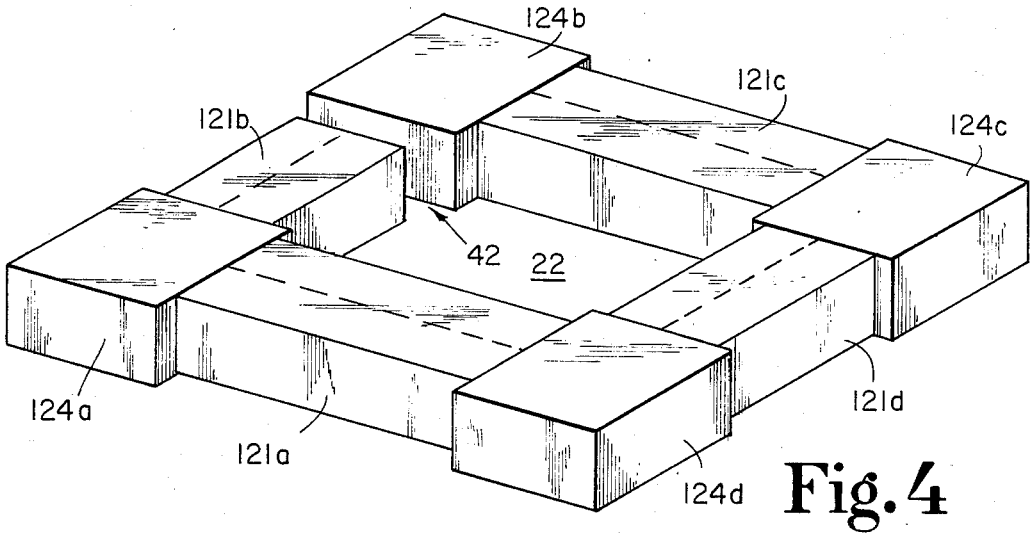
FIG. 4 is a schematic representation of a single-story arrangement of dwelling units wherein the individual dwelling units are of a double width and include a storage area at one end.
Figure 5:
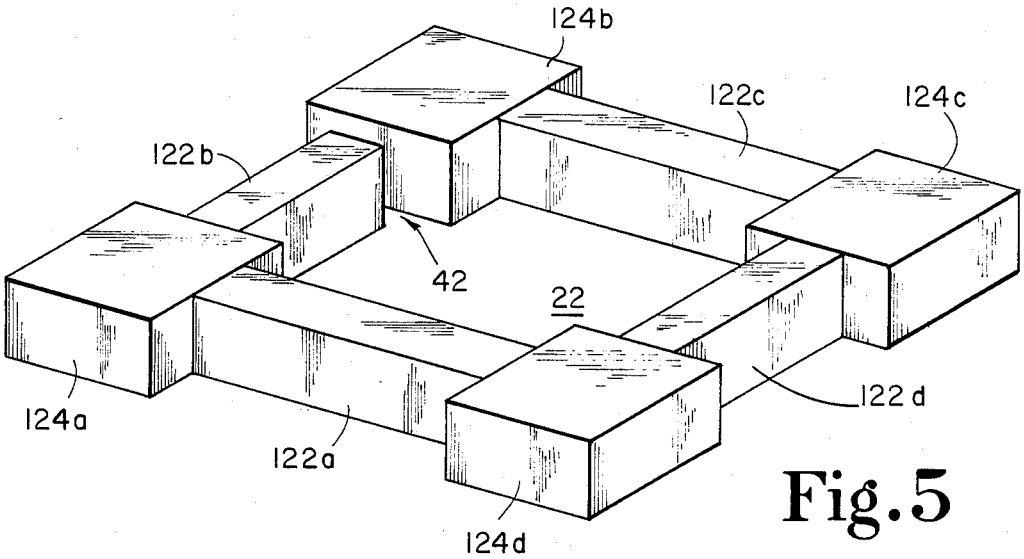
FIG. 5 is a schematic representation of a single-story arrangement of dwelling units wherein each dwelling unit is of a single-width construction with a storage area disposed at one end.
Figure 6:
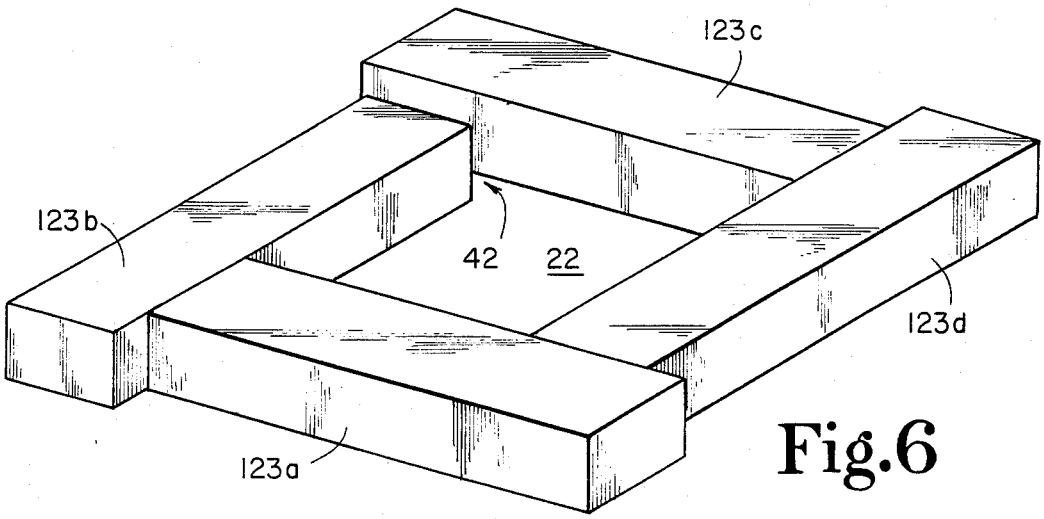
FIG. 6 is a schematic representation of a single-story arrangement of dwelling units wherein each unit is of a double width and the entire unit is arranged for living quarters.

Referring to FIG. 4, the side-to-end orientation of the various elongate units 121*a*–121*d* is shown in schematic block form. The illustration of FIG. 4 represents the general construction concept whether referring to single-width units, double-width units or units wherein the square footage is separated between a living section and a storage (garage) section. What is illustrated in FIG. 4 is in fact a double-width series of units each including a garage 124*a*–124*d* at one end consistent with what has previously been described for FIGS. 1–3. The only difference between FIG. 4 and the previously described construction is found in the courtyard 22. By slightly shifting the living sections relative to the storage sections, a slight offset is created on the interior. This is intended to merely reveal the versatility of the overall construction concept. A schematic block arrangement is provided by FIG. 5 wherein there is a single width unit 122*a*–122*d* with a garage 124*a*–124*d*. The final arrangement is provided by FIG. 6 wherein what is illustrated is a double-wide series of dwelling units 123*a*–123*d* without the garage, and thus the entire square footage is devoted to living space. Although not specifically illustrated, it is to be understood that other variations are envisioned within the scope and teaching of the present invention. For example, it is envisioned that the four individual units could be configured as two-story units, or alternatively, the end-to-side abutment could be spaced so as to provide a plurality of packed access ways into the open-air courtyard. What is illustrated in FIGS. 4, 5 and 6 is an arrangement whereby there is a single access pathway to the enclosed courtyard, and a two-story construction has not been illustrated, although such a construction is considered as part of the present invention. Each elongated unit is disposed substantially perpendicular to its adjacent elongate unit as illustrated.

Although two primary benefits have been previously discussed regarding the present invention, those being the ability to double the square footage by the assembly of two single-width units together into a single double-width unit and the ability to include a storage section or garage as part of the unit. Other benefits from the particular construction are revealed by the enclosed drawings and are commented upon here in order to provide a greater understanding and appreciation for the present invention. The staggered and overlapping end-to-side assembly of the various individual dwelling units into a quadrangle provides not only great strength and rigidity to the overall complex, but as well a great deal of privacy. The various windows for the housing units can be configured in an outwardly facing manner such that no window of any one unit will face toward or into any window of any other unit. Additionally, the courtyard may serve as a convenient area for cookouts, relaxing and sunbathing without being disturbed or bothered by passing motorists or pedestrians. The ability to arrange the various dwelling units such that a single access path is provided to the courtyard insures this degree of privacy.

The single access path 42 is illustrated in FIGS. 3 and 4, yet its location may vary. It is also envisioned that similar paths may be provided, one at each corner. Due to the presence of the path and the open top, the courtyard 22 is disclosed as being generally enclosed, rather than totally enclosed. It should be appreciated that the degree of enclosing is governed by the size of the path.

It should also be noted from the illustrations that the courtyard's plan area is substantial relative to the plan area of any one elongate unit and that further, the plan area of the courtyard is at least as great as the plan area of any one elongate unit.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dwelling structure comprising:

four elongate rectangular living units, each having two long sides and two ends, said elongate living units arranged in quadrangular relationship with respect to each other to enclose an open-air court and further arranged such that one long side of each living unit faces said open-air court and is aligned with the ends of the adjacent living units; and four rectangular storage units, each associated with a respective living unit and arranged such that one side of the storage unit abuts one end of the associated living unit and an adjacent side of the storage unit abuts one end of an adjacent living unit, the sides of the storage units having length dimensions greater than the width dimensions of the abutted living units.

2. The dwelling structure of claim 1, in which the storage units on one side of the quadrangle open in a common first direction and the storage units on the opposite side of the quadrangle open in a common second direction opposite said first direction.

3. A dwelling structure comprising:

four elongate rectangular living units, each having two long sides and two ends, each living unit including two elongate preconstructed halves disposed side-by-side and secured together in an abutting relationship along a longitudinal interface, said elongate living units arranged in quadrangular relationship with respect to each other to enclose an open-air court and further arranged such that one long side of each living unit faces said open-air court and is aligned with the ends of the adjacent living units; and four rectangular storage units, each associated with a single living unit and arranged such that one side of the storage unit abuts one end of the associated living unit and an adjacent side of the storage unit abuts one end of an adjacent living unit, the sides of the storage units having length dimensions greater than the width dimensions of the abutted living units.

4. The dwelling structure of claim 3, in which the storage units on one side of the quadrangle open in a common first direction and the storage units on the opposite side of the quadrangle open in a common second direction opposite said first direction.

5. The dwelling structure of claim 3 wherein each of said rectangular living units includes a gable roof with a longitudinally extending roof apex and each of said rectangular storage units includes a gable roof with a roof apex wherein the roof apex of two oppositely disposed living units extend in substantially the same direction as the roof apexes of said four rectangular storage units and the other two oppositely disposed rectangular living units have their corresponding roof apexes extending in a direction which is different than said first direction.

6. The dwelling structure of claim 3 wherein each of said four rectangular storage units is configured as a garage having a single vehicle entry location, each of said vehicle entry locations opening outwardly and one pair of said rectangular storage units each having a corresponding vehicle entry location opening outwardly in a first direction and said other pair of rectangular storage units each having their corresponding vehicle entry location opening outwardly in a second direction wherein said second direction is substantially opposite to said first direction.

* * * * *